US011438699B2

(12) United States Patent
He et al.

(10) Patent No.: US 11,438,699 B2
(45) Date of Patent: Sep. 6, 2022

(54) MICRO SPEAKER WITH AMPLITUDE STABILITY

(71) Applicant: CONCRAFT HOLDING CO., LTD., Grand Cayman (KY)

(72) Inventors: Si-Si He, New Taipei (TW); Jie-Ru Chen, New Taipei (TW)

(73) Assignee: DRAGONSTATE TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 17/147,184

(22) Filed: Jan. 12, 2021

(65) Prior Publication Data

US 2022/0167091 A1 May 26, 2022

(30) Foreign Application Priority Data

Nov. 24, 2020 (TW) ..... 109141491

(51) Int. Cl.

| | |
|---|---|
| ***H04R 9/04*** | (2006.01) |
| ***H04R 7/18*** | (2006.01) |
| ***H04R 9/06*** | (2006.01) |
| ***H04R 9/02*** | (2006.01) |
| ***H04R 7/12*** | (2006.01) |

(52) U.S. Cl.

CPC ..... *H04R 9/045* (2013.01); *H04R 7/12* (2013.01); *H04R 7/18* (2013.01); *H04R 9/025* (2013.01); *H04R 9/06* (2013.01)

(58) Field of Classification Search

CPC ... H04R 3/00; H04R 3/08; H04R 3/04; H04R 9/06; H04R 9/025; H04R 9/02; H04R 9/063; H04R 9/046; H04R 9/045; H04R 9/041; H04R 9/043; H04R 9/10; H04R 9/047; H04R 1/005; H04R 2400/03; H04R 7/16; H04R 7/22; H04R 7/12; H04R 7/18; H04R 11/00; H04R 11/02; H04R 13/02; H04R 2209/022

USPC ..... 381/117, 396, 400, 405, 411, 412, 420, 381/421

See application file for complete search history.

(56) References Cited

U.S. PATENT DOCUMENTS

| | | | | |
|---|---|---|---|---|
| 10,277,986 | B2 * | 4/2019 | Li | H04R 9/043 |
| 10,299,045 | B2 | 5/2019 | Xiao et al. | |
| 10,448,167 | B2 | 10/2019 | Xiao et al. | |
| 10,728,672 | B2 * | 7/2020 | Kim | H04R 9/045 |

(Continued)

*Primary Examiner* — Ahmad F. Matar
*Assistant Examiner* — Sabrina Diaz
(74) *Attorney, Agent, or Firm* — Muncy, Geissler, Olds & Lowe, P.C.

(57) ABSTRACT

A micro speaker with amplitude stability, includes a vibrating diaphragm unit, a magnetic unit which is disposed below the vibrating diaphragm unit, and a circuit unit which is disposed between the vibrating diaphragm unit and the magnetic unit. The vibrating diaphragm unit includes a diaphragm which is connected with a voice coil; whereas the diaphragm and the voice coil are connected electrically by an upper fixing arm on the vibrating diaphragm unit, and a pair of flexible circuit board disposed in the circuit unit. The circuit unit also includes plural lower fixing arms to connect and support the flexible circuit boards. Therefore, when an external power source energizes the circuit unit, the voice coil can drive the diaphragm to generate a stable amplitude along the height of the magnetic element, through the upper fixing arm and the lower fixing arms.

10 Claims, 10 Drawing Sheets

(56) References Cited

U.S. PATENT DOCUMENTS

| | | | | |
|---|---|---|---|---|
| 10,820,107 | B2 * | 10/2020 | Feng | H04R 9/025 |
| 10,979,819 | B2 * | 4/2021 | Xiao | H04R 7/12 |
| 2016/0057543 | A1 * | 2/2016 | Salvatti | H04R 9/043 381/398 |
| 2020/0137500 | A1 * | 4/2020 | Moenke | H04R 9/043 |
| 2020/0213760 | A1 * | 7/2020 | Liu | H04R 7/18 |
| 2020/0213763 | A1 * | 7/2020 | Hu | H04R 7/18 |
| 2021/0274289 | A1 * | 9/2021 | Wang | H04R 1/06 |

* cited by examiner

MICRO SPEAKER WITH AMPLITUDE STABILITY

BACKGROUND OF THE INVENTION a) Field of the Invention

The present invention relates to a micro speaker, and more particularly to a micro speaker, which allows an internal voice coil to generate an up-and-down amplitude more stably, and prevents from forming oblique collision, upon being energized.

b) Description of the Prior Art

A micro speaker is mainly applied to and installed in an electronic product to carry out electroacoustic conversion through a micro speaker unit, thereby releasing sound.

In a conventional micro speaker unit, a voice coil mainly surrounds a magnetic element to form excitation between the voice coil and the magnetic element after being energized, so that the voice coil can drive a diaphragm above an outer edge of the magnetic element to form an up-and-down amplitude, thereby enabling the diaphragm to tap air to sound. On the other hand, in a conventional micro speaker, the voice coil is mainly connected with the diaphragm, and an upper fixing arm is connected with an outer frame; therefore, when the voice coil is generating the up-and-down amplitude, the diaphragm will also generate an up-and-down amplitude in the center of outer frame by the upper fixing arm. Accordingly, when the voice coil vibrates up and down, a lower part of the voice coil surrounding the magnetic element will result in swing easily, which allows the lower part of voice coil to collide easily with the magnetic element, thereby causing the micro speaker to generate noises.

To improve the phenomenon that the lower part of voice coil collides with the magnetic element when vibrating up and down, in an improved micro speaker (such as a US invention patent publication no. 10,448,167 or 10,299,045), the lower part of voice coil is connected to the outer frame by a lower fixing arm, so that the voice coil can swing less on the outer edge of magnetic element through the upper fixing arm and the lower fixing arm, allowing the voice coil not to collide with the magnetic element. In these prior arts, the lower fixing arms are all disposed on two short edges of the voice coil, and the lower fixing arms and a flexible circuit board are adhered respectively between the outer frame and the voice coil.

Accordingly, as the volume of micro speaker is small, the space between the voice coil and the outer frame will be limited. When the lower fixing arm is disposed on the short edge, the width of lower fixing arm is not enough, which will allow the voice coil to be unable to generate a larger up-and-down amplitude. In addition, as the lower fixing arm is disposed on the short edge, the volume of entire lower fixing arm will be too large, which will also make the lower fixing arm too heavy, and will affect the up-and-down amplitude of the voice coil at a same time. Moreover, the lower fixing arm and the flexible circuit board are designed separately and then are adhered with each other between the voice coil and the outer frame; therefore, when the voice coil is generating the up-and-down amplitude, the flexible circuit board will be pulled easily, which will damage the flexible circuit board easily under a long time of use, thereby affecting the life time of use of the micro speaker.

Accordingly, how to provide a micro speaker that allows the voice coil to be more stable in generating the up-and-down amplitude, and prevents from causing the oblique collision, upon being energized, is an issue to be solved by the present invention.

SUMMARY OF THE INVENTION

A primary object of the present invention is to provide a micro speaker, and more particularly to a micro speaker, which allows an internal voice coil to be more stable in generating an up-and-down amplitude, and prevents from forming oblique collision, upon being energized.

To achieve the abovementioned object, the present invention provides a micro speaker with amplitude stability, comprising at least a vibrating diaphragm unit, a magnetic unit, and a circuit unit. The vibrating diaphragm unit is assembled from an upper casing, a diaphragm, an upper fixing arm, and a voice coil. The diaphragm is disposed in the center location of the upper casing, the upper fixing arm is connected between the upper casing and the diaphragm, and the voice coil is provided with a first end and a second end which are connected with the diaphragm. The magnetic unit is disposed below the vibrating diaphragm unit, and is assembled from a lower casing and at least a magnetic element. The magnetic element is disposed on the lower casing, and the second end of the voice coil surrounds and separates from the magnetic element. The circuit unit is disposed between the vibrating diaphragm unit and the magnetic unit, and is assembled from a middle casing, a pair of flexible circuit board, and a pair of lower fixing arm. The middle casing is disposed between the upper casing and the lower casing, and the voice coil separates from an inner wall of the middle casing, forming a rectangular interval between the voice coil and the inner wall. Each flexible circuit board includes a first electric connecting member, two second electric connecting members, and two electric connecting members. The first electric connecting member is latched in the middle casing and is partly exposed on a bottom surface of the middle casing. Each second electric connecting member is extended into the middle casing and is connected electrically with the second end of the voice coil. Each electric connecting member is connected with the first electric connecting member and the two second electric connecting members. Each electric connecting member is disposed in the interval, and includes a connecting section which is latched in the middle casing, and a bending member which is protruded on the connecting section. Each lower fixing arm includes a jointing member which is formed on the inner wall of the middle casing, two supporting members which are used to support the second electric connecting members, and two elastic connecting arms which are connected between the jointing member and the two supporting members. Each elastic connecting arm encloses a bending member. When an external power source energizes the first electric connecting member, the diaphragm and the voice coil can generate an amplitude stably inside the upper casing and the middle casing along the height of the magnetic element, through the upper fixing arm and the lower fixing arm.

In an embodiment, the interval is assembled from two long edges, two short edges, and four corner edges. Each corner edge is disposed between each long edge and each short edge, and includes an inner corner and an outer corner. The inner corner is formed by the voice coil, and the outer corner is formed by the inner wall of the middle casing. Each bending member of each flexible circuit board is disposed at each corner edge, and each elastic connecting arm of each lower fixing arm is disposed at each corner edge to enclose each bending member.

In an embodiment, each bending member bends toward the lower casing to form a curvature; whereas, each elastic connecting arm and each bending member form a same curvature.

In an embodiment, the larger the radius of each inner corner is, and the smaller the inner radius of each outer corner is, then the larger the area of the corner edge is, and the larger the area of each elastic connecting arm is. In addition, the larger the area of the elastic connecting arm is, then the higher the stability of amplitude that the voice coil generates.

In an embodiment, the jointing member of each lower fixing arm further includes a reinforcing bonding member which is extended from a lower side of the jointing member to be latched into the middle casing along the bottom surface of the middle casing, thereby improving the adhesive strength between the jointing member and the middle casing.

In an embodiment, a reinforcing rib is formed at a bottom of each elastic connecting arm, opposite to each bending member. In addition, the reinforcing rib is protruded on the bottom surface of the elastic connecting arm.

In an embodiment, the middle casing is directly formed on the first electric connecting member of the flexible circuit board by injection molding, enclosing each electric connecting member and each connecting section in the middle casing, and exposing part of the first electric connecting member on the bottom surface of the middle casing.

In an embodiment, the lower fixing arm is directly formed between the middle casing and each second electric connecting member by injection molding.

In an embodiment, the lower fixing arm is formed by injection molding with a silicon material.

In an embodiment, the magnetic unit further includes two auxiliary magnetic elements. The two auxiliary magnetic elements are disposed respectively on a side of the magnetic unit and separate from the magnetic unit.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
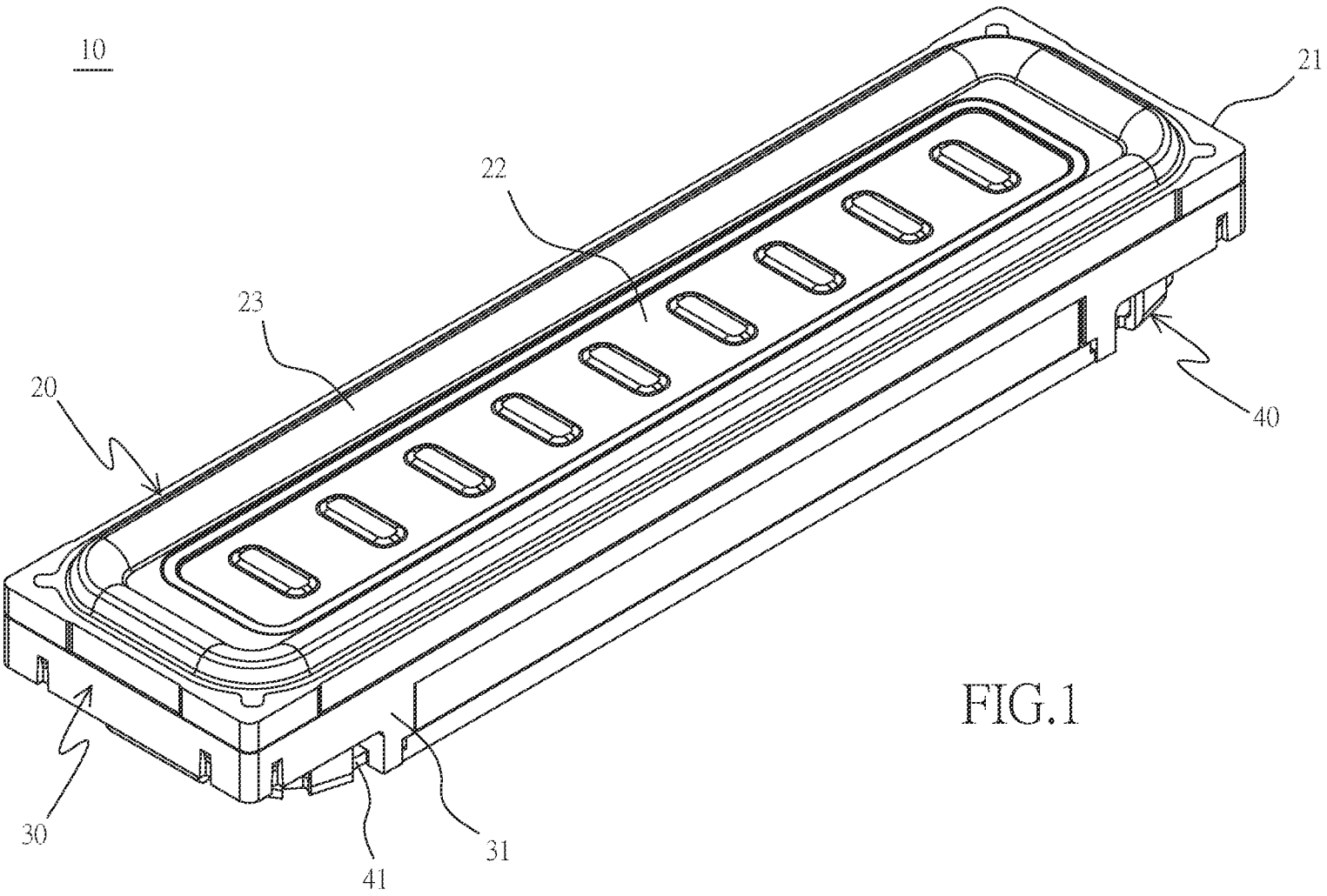
FIG. 1 shows a three-dimensional schematic view of the present invention.
Figure 2:
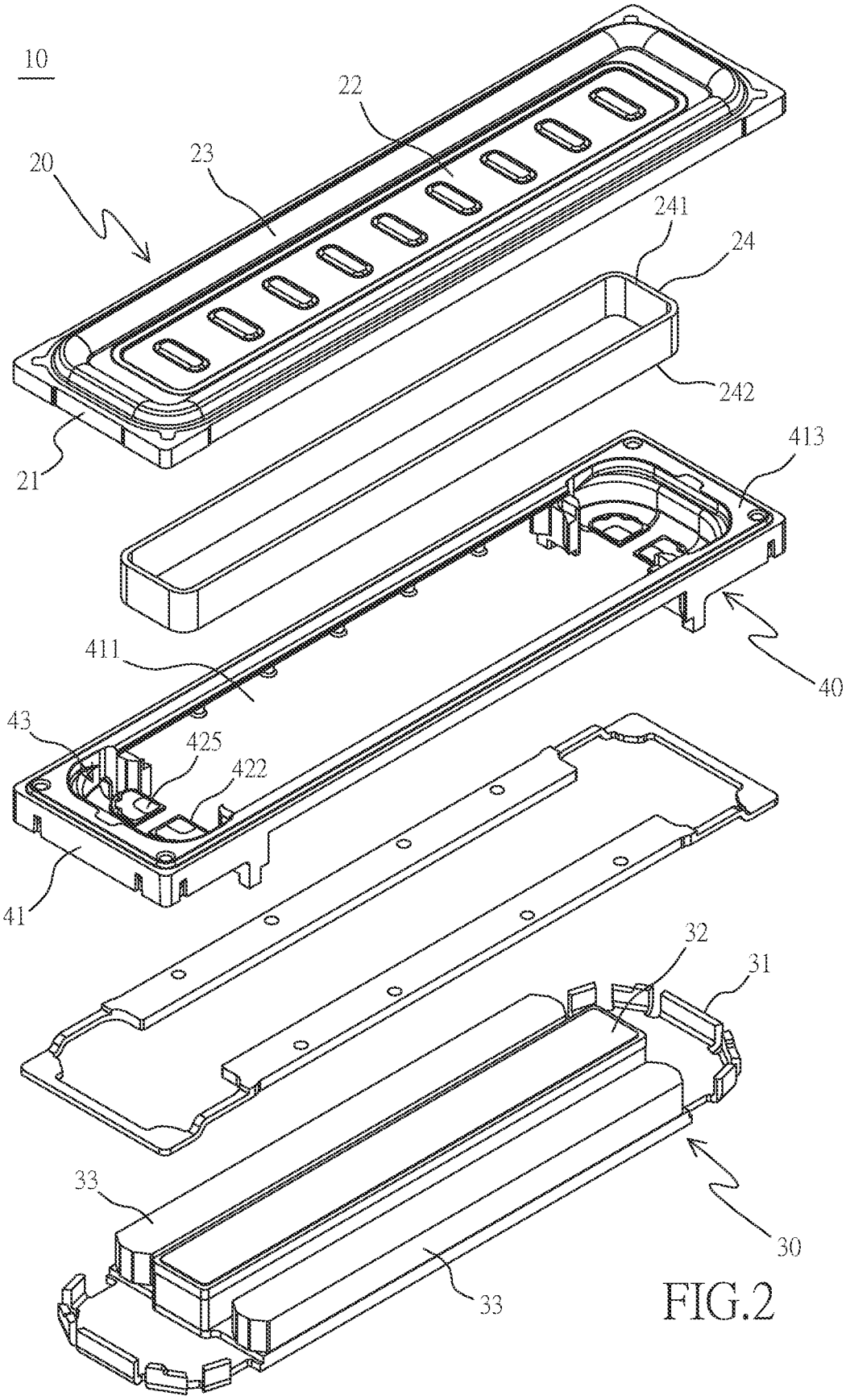
FIG. 2 shows a three-dimensional exploded view of the present invention.
Figure 3:
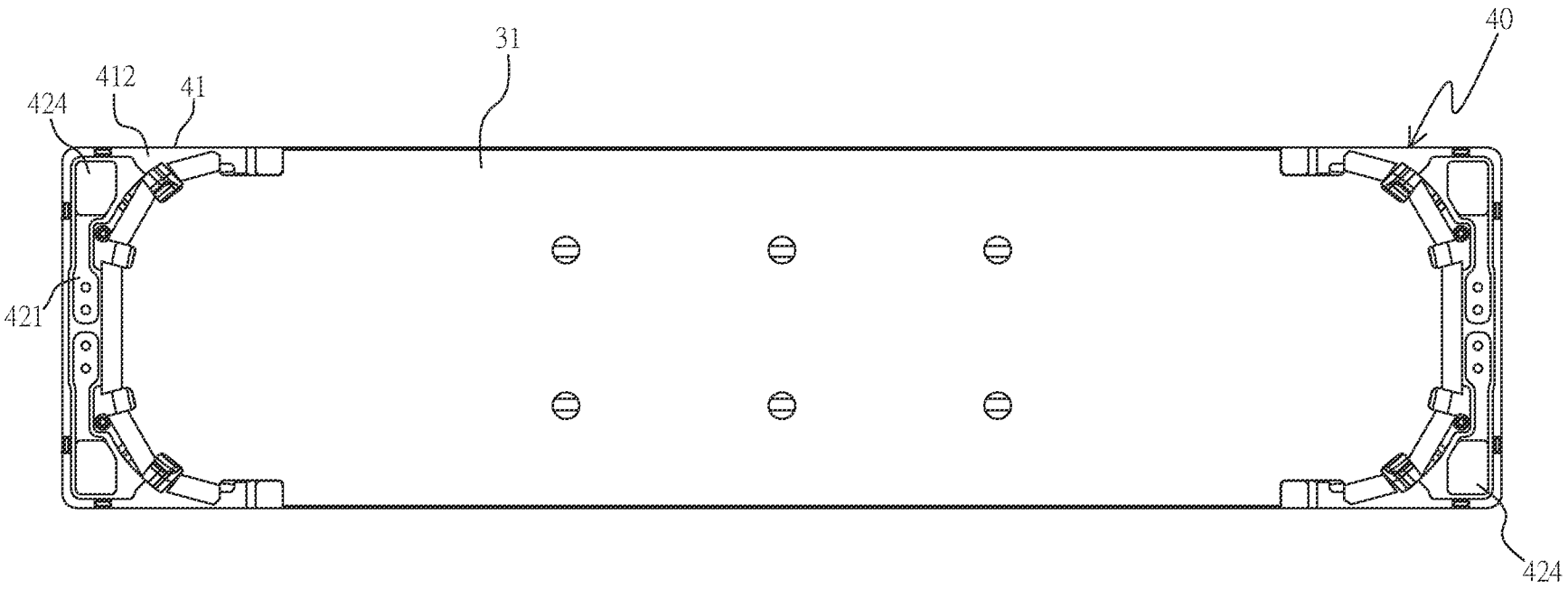
FIG. 3 shows a planar view of a rear part of the present invention.
Figure 4:
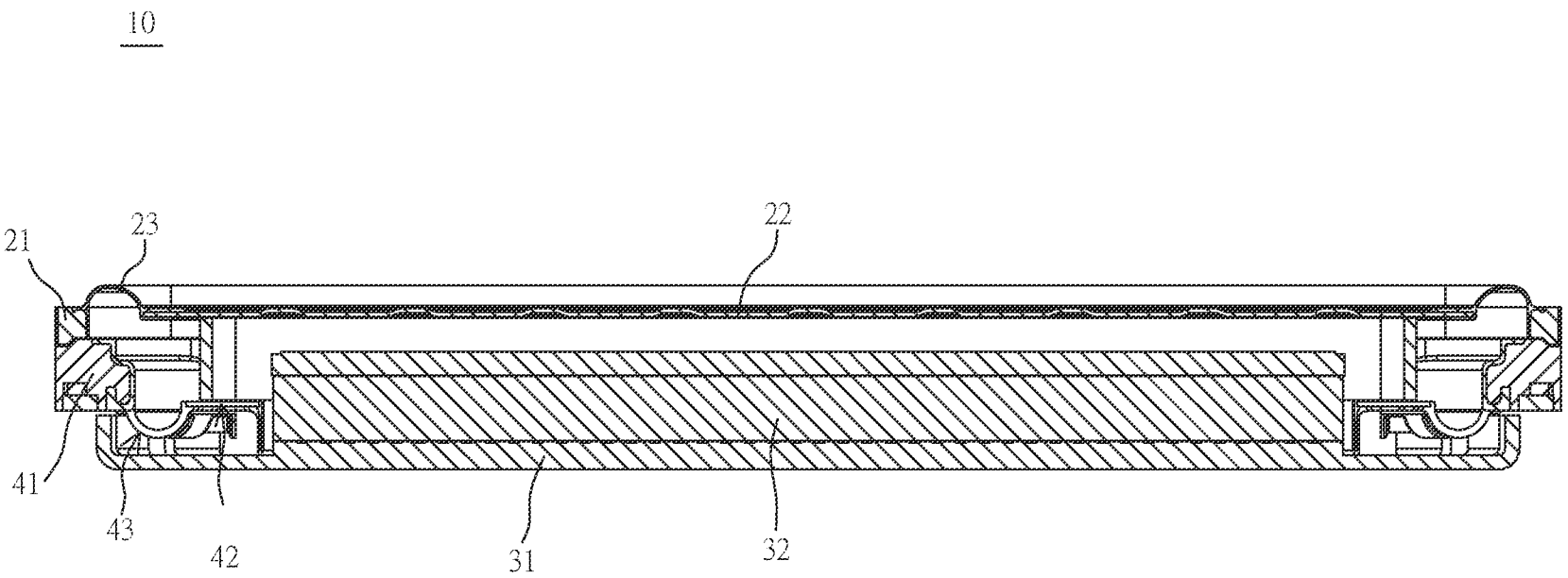
FIG. 4 shows a cutaway view of the present invention.
Figure 5:
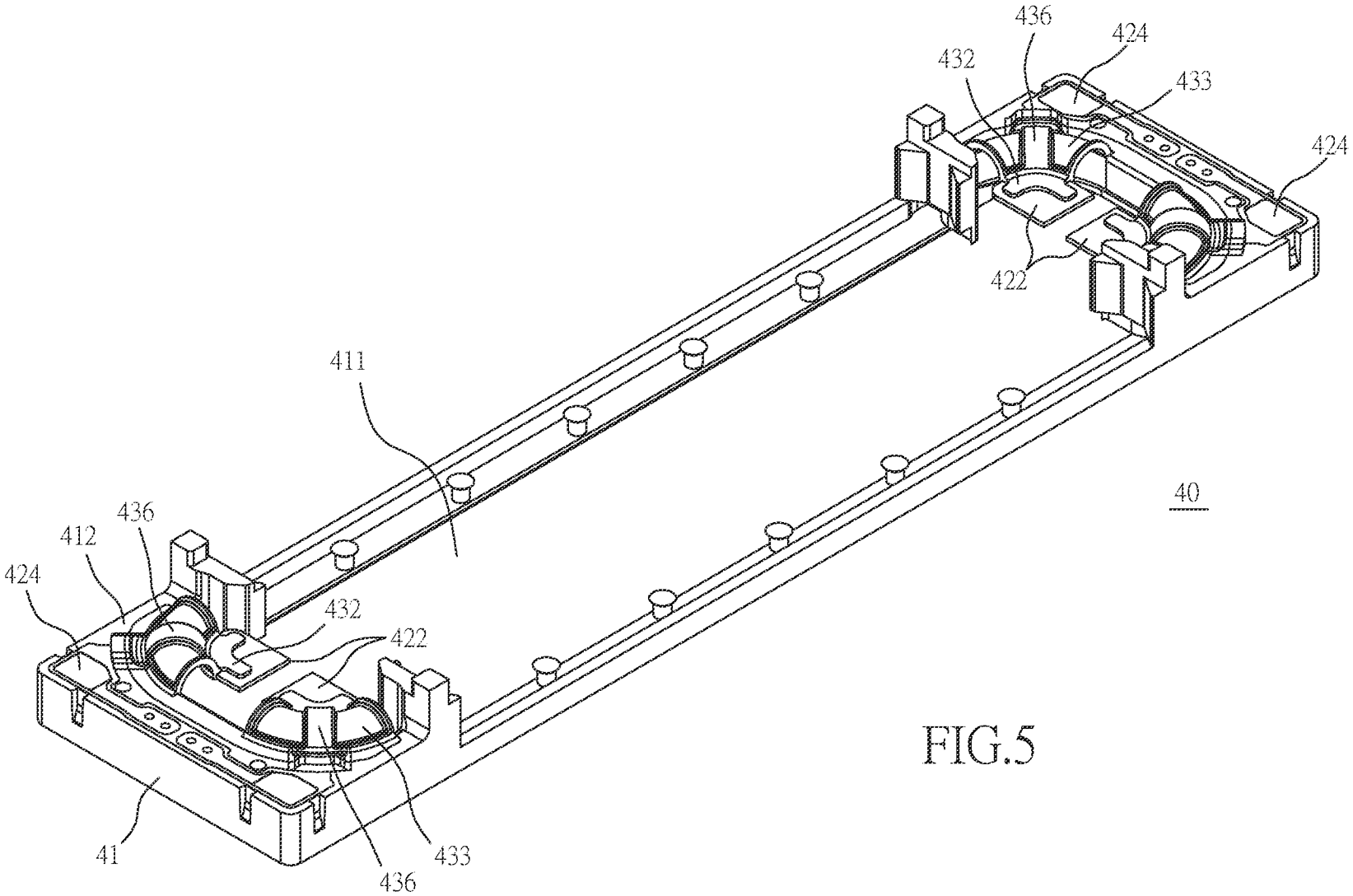
FIG. 5 shows a three-dimensional schematic view of a rear part of a circuit unit, according to the present invention.
Figure 6:
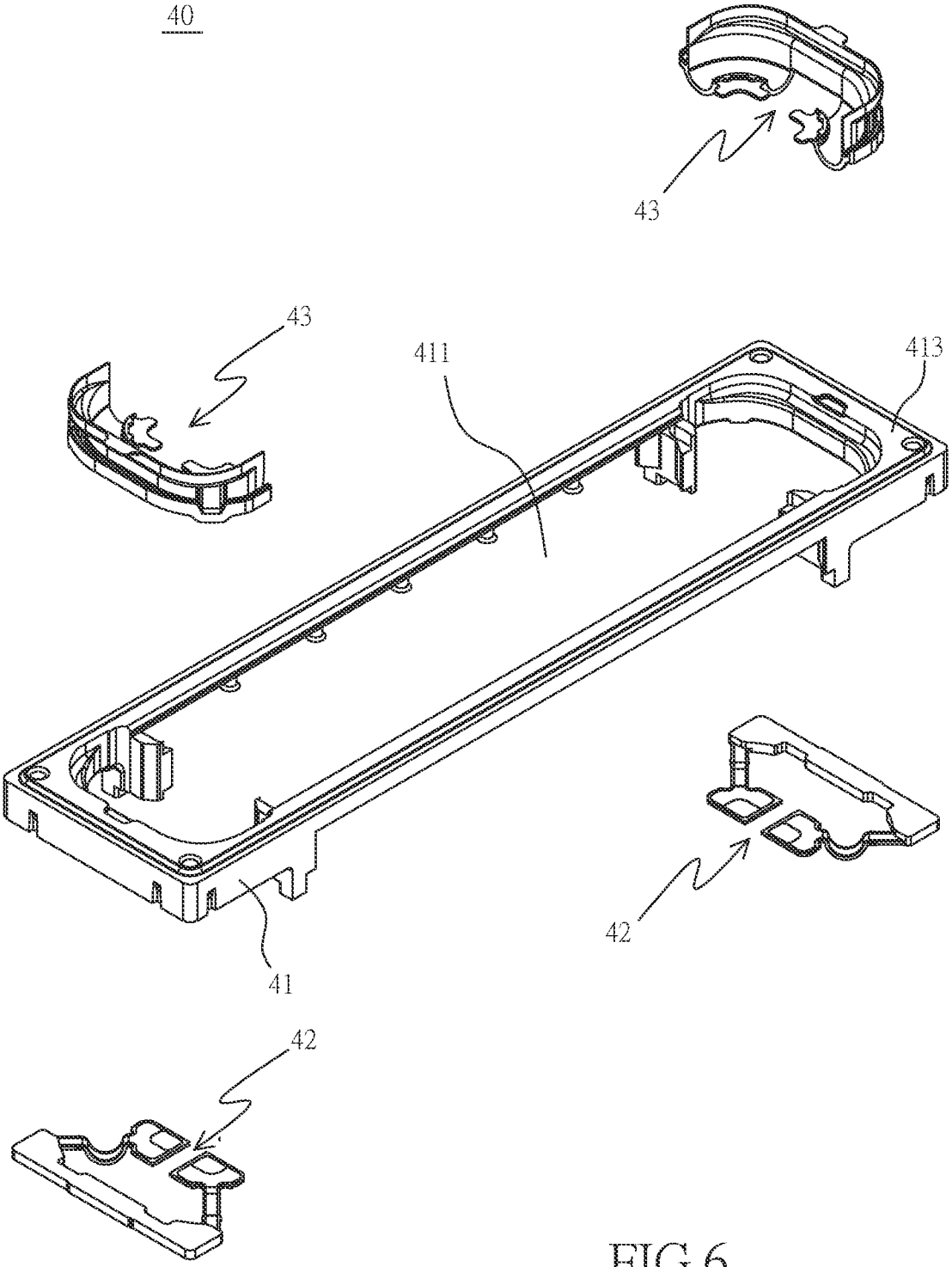
FIG. 6 shows a three-dimensional exploded view of the circuit unit, according to the present invention.
Figure 7:
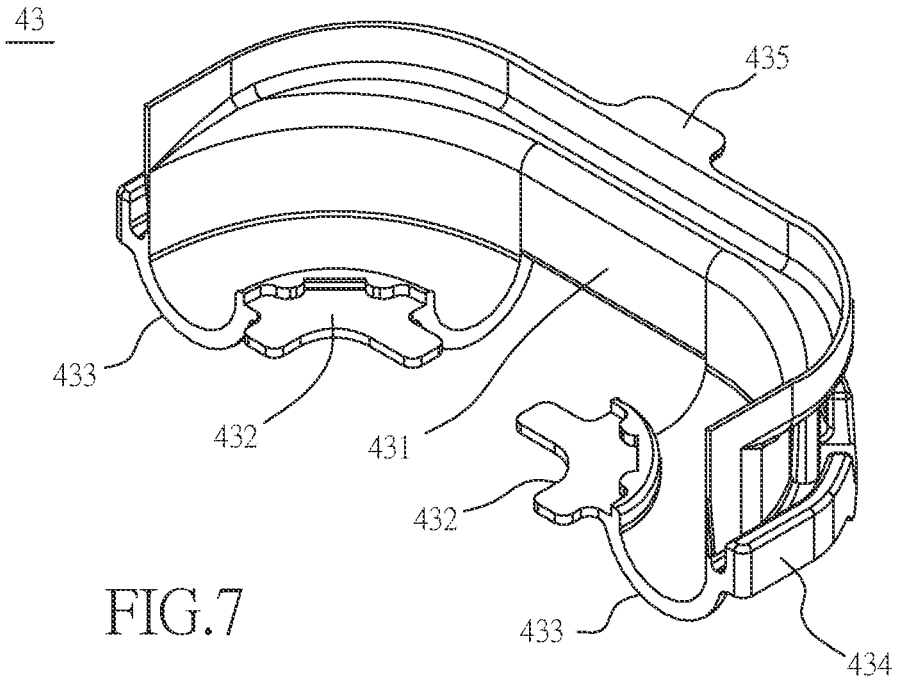
FIG. 7 shows a three-dimensional schematic view of a lower fixing arm, according to the present invention.
Figure 8:
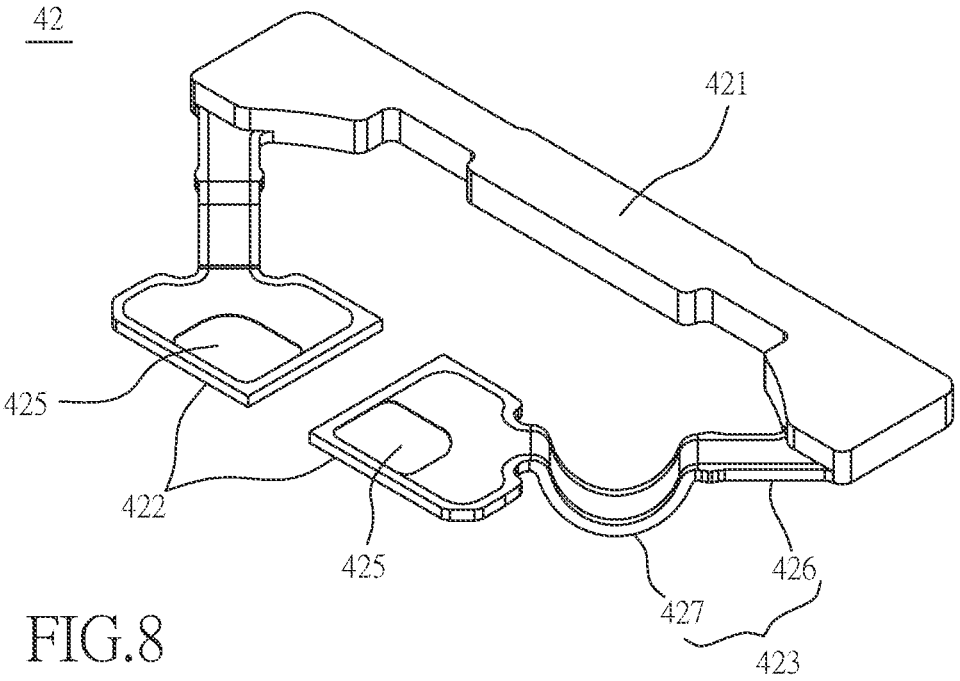
FIG. 8 shows a three-dimensional schematic view of a flexible circuit board, according to the present invention.
Figure 9:
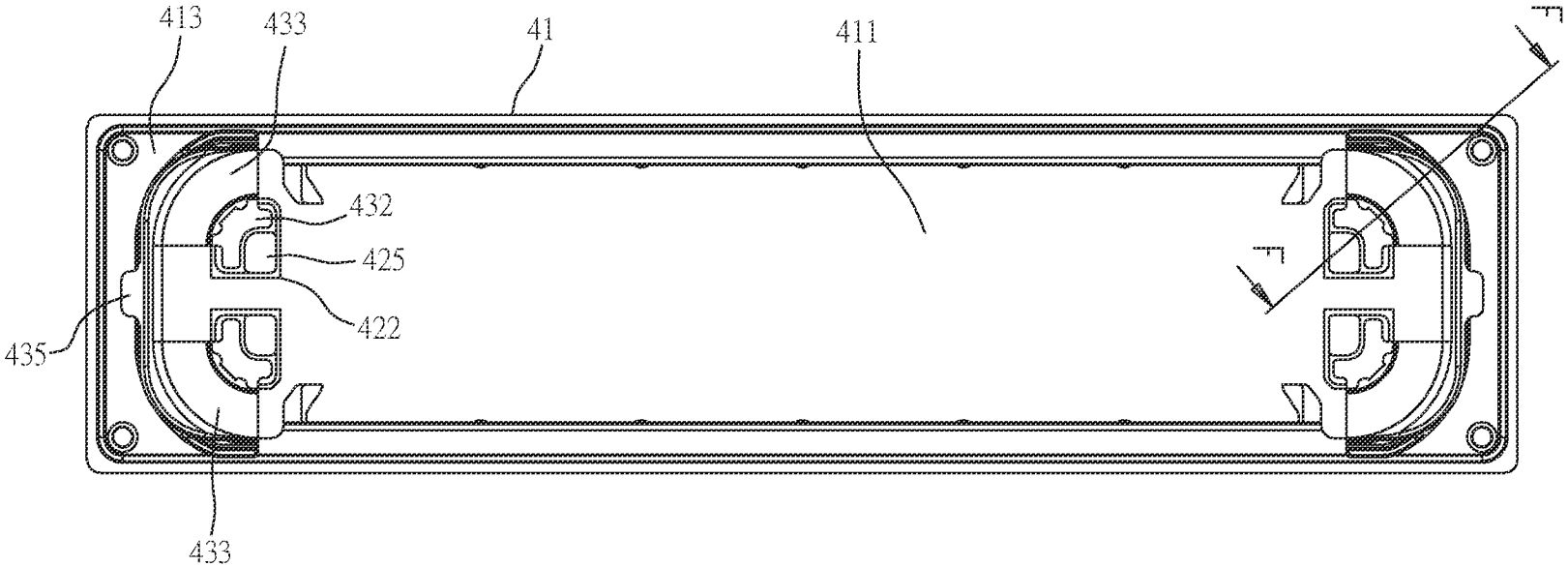
FIG. 9 shows a planar view of the circuit unit, according to the present invention.
Figure 10:
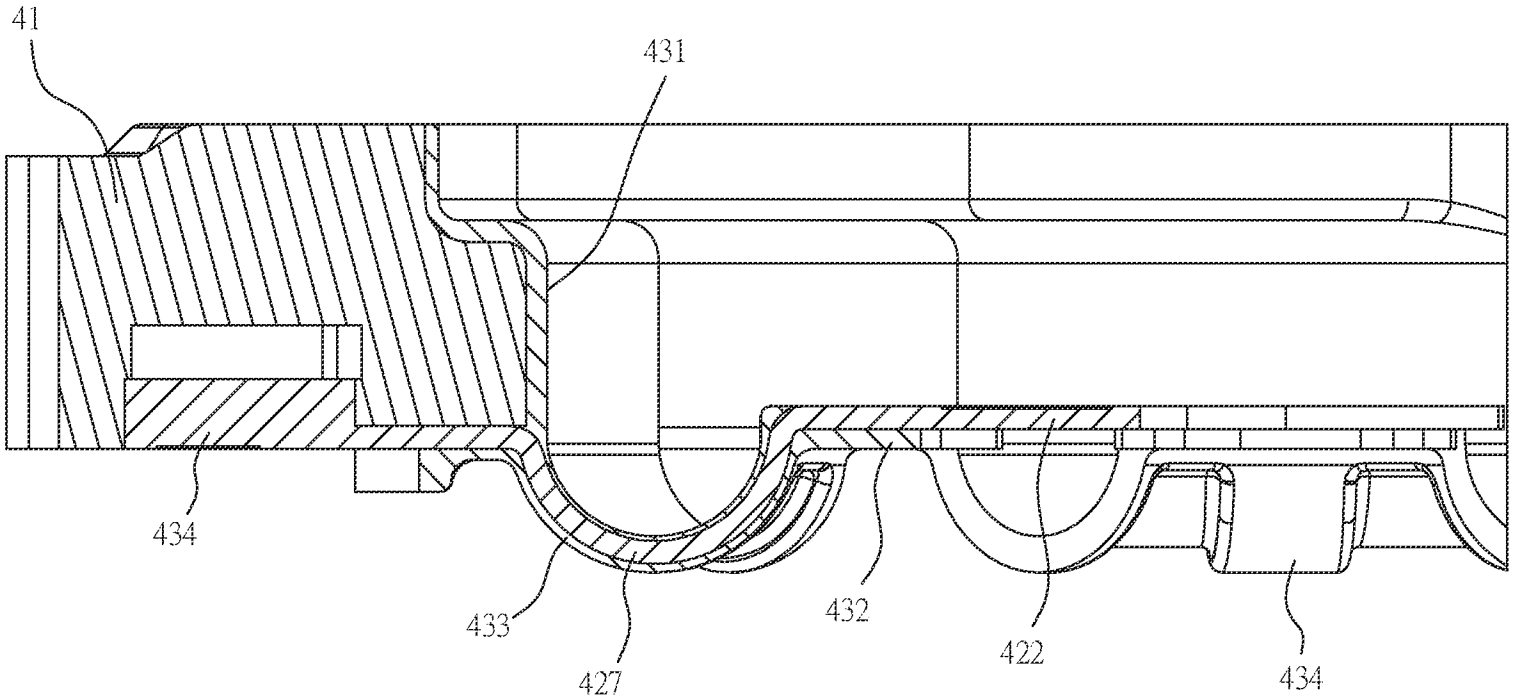
FIG. 10 shows a partially enlarged view of FIG. 9.
Figure 11:
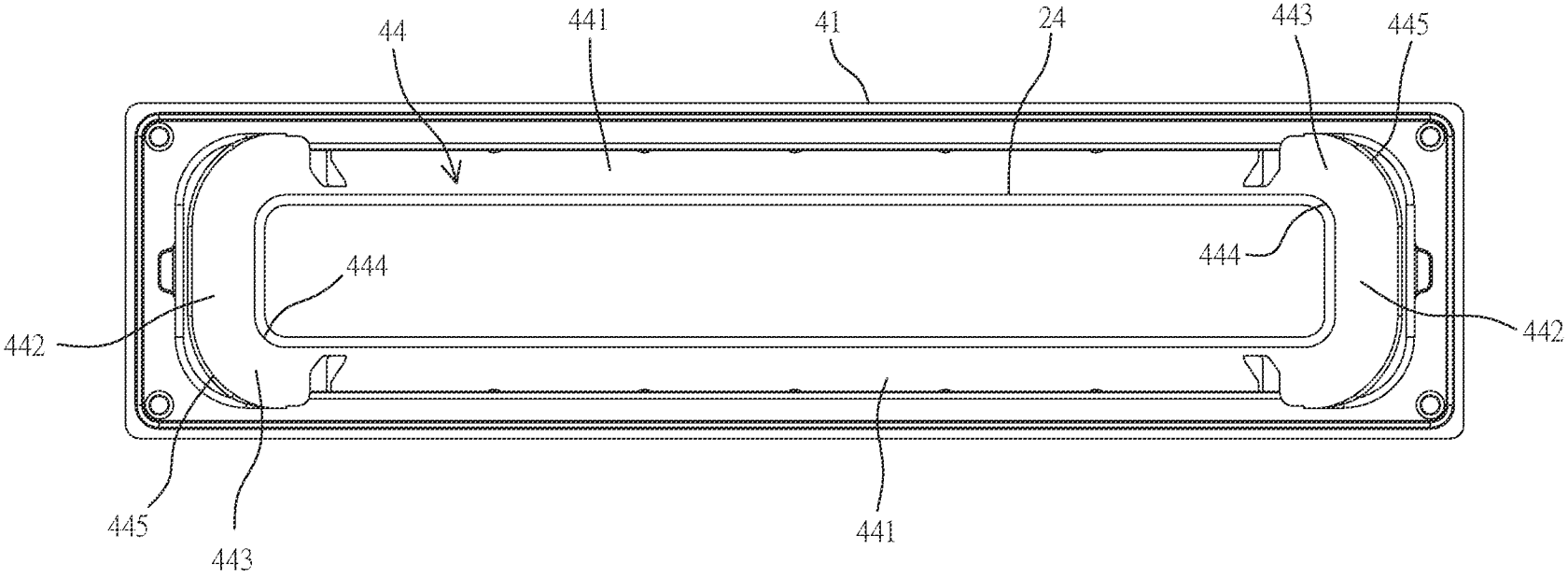
FIG. 11 shows a schematic view of an interval of the present invention.

Referring to FIG. 1 to FIG. 11, the present invention discloses a micro speaker 10 with amplitude stability. The micro speaker 10 comprises a vibrating diaphragm unit 20, a magnetic unit 30, and a circuit unit 40.

The vibrating diaphragm unit 20 is provided with an upper casing 21, a diaphragm 22 which is disposed in the center of upper casing 21 and is separated from the upper casing 21, an upper fixing arm 23 which surrounds between the upper casing 21 and the diaphragm 22, and a voice coil 24 which is connected below the diaphragm 22 and is extended toward the magnetic unit 30. The voice coil 24 is provided with a first end 241 which is connected on the diaphragm 22, and a second end 242 which is extended toward the magnetic unit 30, so that the diaphragm 22 and the voice coil 24 can be provided with an up-and-down amplitude effect in the center of upper casing 21 through the diaphragm 22.

The magnetic unit 30 is disposed below the vibrating diaphragm unit 20 and is assembled from a lower casing 31, a magnetic element 32 which is disposed on the lower casing 31, and two auxiliary magnetic elements 33 which are disposed on the lower casing 31 and located respectively on a side of the magnetic element 32. The voice coil 24 surrounds the magnetic element 32 and is disposed between the magnetic element 32 and the two auxiliary magnetic elements 33; whereas, the two auxiliary magnetic elements 33 are disposed respectively on a long edge of the lower casing 31.

The circuit unit 40 is disposed between the vibrating diaphragm unit 20 and the magnetic unit 30. The volume of circuit unit 40 is about the same as the projected area of vibrating diaphragm unit 20; whereas the projected area of magnetic unit 30 is smaller than the area of circuit unit 40. The circuit unit 40 is provided with a middle casing 41 which is disposed between the upper casing 21 and the lower casing 31, a pair of flexible circuit board 42, and a pair of lower fixing arm 43. The middle casing 41 is roughly in a rectangular shape, with a center thereof being formed with an accommodation space 411. The flexible circuit boards 42 and the lower fixing arms 43 are disposed respectively on a short edge of the middle casing 41, corresponding to one another; one flexible circuit board 42 corresponds to one lower fixing arm 43, and the other flexible circuit board 42 corresponds to the other lower fixing arm 43. On the other hand, each flexible circuit board 42 is provided with a first electric connecting member 421, two second electric connecting members 422, and two electric connecting members 423 which are extended from the first electric connecting member 421 to be connected with each second electric connecting member 422, respectively. In the present embodiment, the first electric connecting member 421 is latched in the middle casing 41, and a side of the first electric connecting member 421 is exposed on a bottom surface 412 of the middle casing 41, allowing plural first electric contacts 424 on the first electric connecting member 421 to be exposed on the bottom surface 412 of the middle casing 41. Each second electric connecting member 422 is protruded in the accommodation space 411, so that at least one second electric contact 425 on each second electric connecting member 422 can be exposed in the accommodation space 411, and can be connected electrically with the second end 242 of the voice coil 24 through the second electric contact 425. Each electric connecting member 423 is provided with a connecting section 426 which is extended from the first electric connecting member 421 and is latched in the middle casing 41, and a bending member 427 which is extended into the accommodation space 411. Each bending member 427 is extended toward the magnetic unit 30, forming a curvature. Each lower fixing arm 43 includes a jointing member 431 which is connected on an inner wall of the middle casing 41, two supporting members 432 which support the two second electric connecting members 422, and two elastic connecting arms 433 which are extended from the jointing member 431 to be connected with one supporting member 432 and enclose the bending member 427, so that the elastic connecting arms 433 can enclose the bending member 427 completely, and the elastic connecting arms 433 and the bending member 427 can have the same curvature.

In the present embodiment, the circuit unit 40 is constituted by firstly forming the flexible circuit boards 42, followed by putting the flexible circuit boards 42 into a first mold (not shown in the drawings), respectively. Next, the flexible circuit boards 42 are formed into the middle casing 41 by injection molding with a forming material (such as plastic). Thus, each first electric connecting member 421 and each connecting section 426 on the flexible circuit boards 42 can be enclosed by the middle casing 41, and part of the first electric connecting member 421 can be exposed on the bottom surface 412 of the middle casing 41, so that the first electric connecting member 421 can be connected electrically with an external power source (not shown in the drawings). Therefore, the flexible circuit boards 42 will not escape from the middle casing 41. The lower fixing arms 43 are directly formed on the middle casing 41 and the flexible circuit boards 42 by injection molding, as well; after forming the middle casing 41, the middle casing 41 and the two flexible circuit boards 42 are put into a second mold (not shown in the drawings), and then, a silicon material in a liquid state is injected into the second mold. When the silicon material is solidified in the second mold, the lower fixing arms 43 can be formed. Accordingly, each elastic connecting arm 433 can actually enclose each bending member 427, which avoids each elastic connecting arm 433 to escape from each bending member 427, and allows the supporting members 432 to support the second electric connecting members 422, so that the second electric connecting members 422 can be connected electrically with the second end 242 of the voice coil 24 effectively, through the second electric contacts 425.

Furthermore, in the present embodiment, in order to increase the binding effect between each lower fixing arm 43 and the middle casing 41, a reinforcing bonding member 434, which is extended to the bottom surface 412 of the middle casing 41 and is latched in the middle casing 41, is formed underneath the jointing member 431 of each lower fixing arm 43. On the other hand, an auxiliary bonding member 435 which is extended to an upper surface of the middle casing 41 is formed above each jointing member 431, so that the lower fixing arms 43 can be bonded stably on the middle casing 41 by the jointing members 431, the reinforcing bonding members 434, and the auxiliary bonding members 435.

It is worth mentioning that, in the present embodiment, when the vibrating diaphragm unit 20, the magnetic unit 30, and the circuit unit 40, are inter-assembled, a roughly rectangular interval 44 will be formed between the voice coil 24 and the inner wall of middle casing 41. The interval 44 is formed by two long edges 441, two short edges 442, and four corner edges 443. Each corner edge 443 is disposed between each long edge 441 and each short edge 442; whereas, each corner edge 443 includes an inner corner 444 and an outer corner 445. The inner corner 444 is formed by the voice coil 24, and the outer corner 445 is formed by the inner wall of middle casing 41. Each second electric connecting member 422 and each supporting member 432 are disposed at each inner corner 444; whereas, each bending member 427 and each elastic connecting arm 433 are disposed between the outer corner 445 and the inner corner 444. Therefore, the larger the radius of inner corner 444 is and the smaller the radius of outer corner 445 is, then the larger the distance between each inner corner 444 and each outer corner 445 is. Accordingly, the area of each elastic connecting arm 433 can be adjusted following the change in the radius of inner corner 444 and in the radius of outer corner 445, so that in the product design phase, the radius of inner corner 444 and the radius of outer corner 445 can be changed according to the requirement of the magnitude of an amplitude of the diaphragm 22, in order to change the area of elastic connecting arm 433, thereby allowing each elastic connecting arm 433 to have an improved amplitude effect, without changing the length and width of voice coil 24.

Moreover, in the present embodiment, each connecting section 426 of each flexible circuit board 42 is extended outward through each outer corner 445 of the middle casing 41, and is connected with each bending member 427, in the direction where each outer corner 445 is extended to each inner corner 444. Therefore, when each elastic connecting arm 433 is formed at the outer corner 445 and the inner corner 444, each elastic connecting arm 433 can enclose actually each bending member 427. In addition, a reinforcing rib 436 is protruded outward below each elastic connecting arm 433, opposite to each bending member 427; by the reinforcing rib 436, each bending member 427 can be supported, and the structural strength of the elastic connecting arm 433 can be increased. On the other hand, the two elastic connecting arms 433 of each lower fixing arm 43 are not interconnected on each short edge, thereby reducing the weight of each elastic connecting arm 433.

Accordingly, when the vibrating diaphragm unit 20, the magnetic unit 30, and the circuit unit 40, are assembled, the micro speaker 10 can be formed. On the other hand, when the first electric contacts 424 that are exposed on the bottom surface 412 of the middle casing 41 are connected electrically with the external power source, the voice coil 24 will have an excitation reaction with the magnetic element 32 and two auxiliary magnetic elements 33 through the two flexible circuit boards 42, thereby enabling the voice coil 24 to result in an up-and-down amplitude along the height of magnetic element 32. In the meantime, the voice coil 24 will drive the diaphragm 22 to vibrate to sound. When the voice coil 24 is vibrating up and down, the voice coil 24 will vibrate up and down more stably at the outer edge of magnetic element 32 due to the pulling of upper fixing arm 23 and lower fixing arm 43, so that the voice coil 24 will not be skewed upon vibrating up and down to collide with the magnetic element 32, thereby improving the stability of operation of the micro speaker 10.

It is worth mentioning that the elastic connecting arm 443, in the present invention, is extended between the inner corner 444 and the outer corner 445, which keeps a good spacing between the voice coil 24 and the middle casing 41, and reduces the weight of lower fixing arm 43 effectively, so that the voice coil 24 can generate a larger amplitude at the outer edge of magnetic element 32, thereby improving the sound effect of entire micro speaker 10.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. A micro speaker unit with amplitude stability, comprising:

a vibrating diaphragm unit, which is assembled from an upper casing, a diaphragm, an upper fixing arm and a voice coil, with the diaphragm being disposed in the center of upper casing, the upper fixing arm being connected between the upper casing and the diaphragm, and the voice coil being provided with a first end and a second end, the first end being connected with the diaphragm;

a magnetic unit, which is disposed below the vibrating diaphragm unit and is assembled from a lower casing and a magnetic element, with the magnetic element being disposed on the lower casing, and the second end of the voice coil surrounding and separating from the magnetic element; and a circuit unit, which is disposed between the vibrating diaphragm unit and the magnetic unit, and is assembled from a middle casing, a pair of flexible circuit boards and a pair of lower fixing arms;

wherein, the middle casing is disposed between the upper casing and the lower casing, and the voice coil separates from an inner wall of the middle casing to form an interval between the voice coil and the inner wall; each flexible circuit board includes a first electric connecting member which is latched in the middle casing and is partly exposed on a bottom surface of the middle casing, two second electric connecting members which are extended respectively into a space formed by the middle casing where the voice coil is located and interconnected with the second end of the voice coil electrically, and two electric connecting members which are connected respectively with the first electric connecting member and the two second electric connecting members; each electric connecting member is disposed in the interval, and includes a connecting section which is latched in the middle casing, and a bending member which is protruded on the connecting section; each lower fixing arm includes a jointing member which is formed on the inner wall of the middle casing, two supporting members which are used to support the second electric connecting members, and two elastic connecting arms with each elastic connecting arm being connected between the jointing member and the supporting member, respectively; each elastic connecting arm encloses the bending member; and when an external power source energizes the first electric connecting member, the diaphragm and the voice coil generate an amplitude stably along the height of magnetic element in the upper casing and the middle casing, as a result of pulling by the upper fixing arm and the lower fixing arm.

2. The micro speaker with amplitude stability, according to claim 1, wherein the interval is assembled from two long edges, two short edges, and four corner edges, with each corner edge being disposed between each long edge and each short edge, each corner edge including an inner corner and an outer corner, the inner corner being formed by the voice coil, the outer corner being formed by the inner wall of the middle casing, each bending member of each flexible circuit board being disposed at each corner edge, and each elastic connecting arm of each lower fixing arm being disposed at each corner edge to enclose each bending member.

3. The micro speaker with amplitude stability, according to claim 2, wherein each bending member bends toward the lower casing to form a curvature, and each elastic connecting arm forms the same curvature as each bending member.

4. The micro speaker with amplitude stability, according to claim 2, wherein an area of each corner edge is defined by a radius of each inner corner and a radius of each outer corner, and the larger the an area of each elastic connecting arm is adjusted based on the radius of each inner corner and the radius of each outer corner, and the stability of amplitude that the voice coil generates is increased by the adjusted area of each elastic connecting arm.

5. The micro speaker with amplitude stability, according to claim 1, wherein the jointing member of each lower fixing arm further includes a reinforcing bonding member which is extended from a lower side of the jointing member, extended along the bottom surface of the middle casing, and latched into the middle casing, thereby improving the adhesive strength between the jointing member and the middle casing.

6. The micro speaker with amplitude stability, according to claim 5, wherein a bottom of each elastic connecting arm is formed with a reinforcing rib corresponding to each bending member, with the reinforcing rib being protruded on the bottom surface of the elastic connecting arm.

7. The micro speaker with amplitude stability, according to claim 1, wherein the middle casing is directly formed on the first electric connecting member of the flexible circuit board by injection molding, thereby enclosing each electric connecting member and each connecting section in the middle casing, with part of the first electric connecting member being exposed on the bottom surface of the middle casing.

8. The micro speaker with amplitude stability, according to claim 7, wherein the lower fixing arm is directly formed between the middle casing and each second electric connecting member by injection molding.

9. The micro speaker with amplitude stability, according to claim 8, wherein the lower fixing arm is formed by injection molding with a silicon material.

10. The micro speaker with amplitude stability, according to claim 1, wherein the magnetic unit further includes two auxiliary magnetic elements, whereas the two auxiliary magnetic elements are disposed on a side of the magnetic unit respectively, and separate from the magnetic unit respectively.

* * * * *